United States Patent [19]

Herbst et al.

[11] Patent Number: 4,853,187

[45] Date of Patent: Aug. 1, 1989

[54] APPARATUS TO REDUCE $NO_x$ EMISSIONS FROM A FLUID CATALYTIC CRACKING UNIT

[75] Inventors: Joseph A. Herbst, Turnersville; Hartley Owen, Belle Mead, both of N.J.; Paul H. Schipper, Wilmington, Del.

[73] Assignee: Mobil Oil Corporation, New York, N.Y.

[21] Appl. No.: 188,817

[22] Filed: May 2, 1988

Related U.S. Application Data

[62] Division of Ser. No. 903,344, Sep. 3, 1986, abandoned.

[51] Int. Cl.[4] ..... F27B 15/08; F27B 15/00

[52] U.S. Cl. ..... 422/144; 422/142; 422/145; 422/147

[58] Field of Search ..... 422/140, 141, 144, 145, 422/146, 147, 171, 178, 194, 142

[56] References Cited

U.S. PATENT DOCUMENTS

| | | | |
|---|---|---|---|
| 3,392,110 | 7/1968 | Payne | 208/120 |
| 3,713,781 | 1/1973 | Dunn | 422/145 X |
| 3,821,103 | 6/1974 | Owen et al. | 208/72 |
| 3,886,060 | 5/1975 | Owen | 208/155 |
| 3,894,935 | 7/1975 | Owen | 208/78 |
| 3,926,843 | 12/1975 | Owen | 252/417 |
| 4,219,407 | 8/1980 | Haddad et al. | 208/151 |
| 4,272,402 | 6/1981 | Mayes | 422/144 X |
| 4,283,273 | 8/1981 | Owen | 208/113 |
| 4,313,848 | 2/1982 | Scott | 252/418 |
| 4,325,833 | 4/1982 | Scott | 252/417 |
| 4,336,160 | 6/1982 | Dean et al. | 252/417 |
| 4,359,378 | 11/1982 | Scott | 208/120 |
| 4,388,218 | 6/1983 | Rowe | 252/417 |
| 4,402,913 | 9/1983 | McKinney | 422/144 X |
| 4,404,095 | 9/1983 | Haddad et al. | 208/161 |
| 4,427,537 | 1/1984 | Dean et al. | 208/120 |
| 4,438,071 | 3/1984 | Vickers et al. | 422/145 |
| 4,444,722 | 4/1984 | Owen | 422/144 |
| 4,448,753 | 5/1984 | Gross et al. | 422/144 |
| 4,478,708 | 10/1984 | Farnsworth | 208/161 |
| 4,482,451 | 11/1984 | Kemp | 422/144 X |
| 4,502,947 | 3/1985 | Haddad et al. | 208/161 |
| 4,511,434 | 4/1985 | Vasalos | 422/142 X |
| 4,584,090 | 4/1986 | Farnsworth | 208/80 |
| 4,601,814 | 7/1986 | Mauleon et al. | 422/145 X |

*Primary Examiner*—Michael S. Marcus
*Assistant Examiner*—Rebekah A. Griffith
*Attorney, Agent, or Firm*—Alexander J. McKillop; Charles J. Speciale; Richard D. Stone

[57] ABSTRACT

A multistage process for reducing $NO_x$ in flue gas from fluid catalystic cracking catalyst regeneration. Flue gas is preferably removed after each stage. A portion of $NO_x$ formed in an upstream portion of first and second regeneration stages is converted to $N_2$, prior to discharge from the first and second stages, respectively, by operating downstream ends of the respective first and second stages at oxygen-lean conditions. The present invention also may provide staged regeneration, to reduce $NO_x$ in flue gas, by passing spent catalyst through a transport reactor in plug type flow and sequentially contacting the catalyst with a plurality of oxygen-containing streams.

9 Claims, 4 Drawing Sheets

APPARATUS TO REDUCE $NO_x$ EMISSIONS FROM A FLUID CATALYTIC CRACKING UNIT

This is a division of application Ser. No. 903,344 filed on Sept. 3, 1986, and now abandoned.

BACKGROUND OF THE INVENTION

1. Field of the Invention

This invention relates to a process and apparatus for regenerating fluidized cracking catalyst. More particularly, it relates to a process and apparatus including staged regeneration and separation of flue gas from catalyst particles to minimize—or substantially eliminate—hydrothermal deactivation and $NO_x$ formation.

2. Discussion of the Prior Art

The field of catalytic cracking, and particularly fluid catalyst operations, has undergone significant development and improvements due primarily to advances in catalyst technology and product distribution obtained therefrom. With the advent of high activity catalysts, and particularly crystalline zeolite cracking catalysts, new areas of operating technology have been encountered, requiring even further refinements in processing techniques to take advantage of the high catalyst activity, selectivity and operating sensitivity.

By way of background, the hydrocarbon conversion catalyst usually employed in a fluid catalytic cracking (FCC) installation is preferably a high activity crystalline zeolite catalyst of a fluidizable particle size. The catalyst is transferred in suspended or dispersed phase condition generally upwardly through one or more riser conversion zones (fluid catalytic cracking zones), providing a hydrocarbon residence time in each conversion zone in the range of 0.5 to about 10 seconds, and usually less than about 8 seconds. High temperature riser hydrocarbon conversions, occurring at temperatures of at least 1000° F. or higher and at 0.5 to 4 seconds hydrocarbon residence time in contact with the catalyst in the riser, are desirable for some operations before initiating separation of vaporous hydrocarbon product materials from the catalyst. Rapid separation of catalyst from hydrocarbons discharged from a riser conversion zone is particularly desirable for restricting hydrocarbon conversion time.

During the hydrocarbon conversion step, carbonaceous deposits accumulate on the catalyst particles and the particles entrain hydrocarbon vapors upon removal from the hydrocarbon conversion step. The entrained hydrocarbons are subjected to further contact with the catalyst until they are removed from the catalyst by stripping gas in a separate catalyst stripping zone. Hydrocarbon conversion products separated from the catalyst and stripped materials are combined and typically passed to a product fractionation step. Stripped catalyst (spent catalyst) containing deactivating amounts of carbonaceous material, hereinafter referred to as coke, is then passed to a catalyst regeneration operation.

In catalyst regeneration, the spent catalyst contacts oxygen to burn off coke. However, spent catalyst contains hydrogen-containing components, such as coke, adhering thereto. This causes hydrothermal degradation because the hydrogen reacts with oxygen in the regenerator to form water.

U.S. Pat. No. 4,336,160 to Dean et al attempts to reduce hydrothermal degradation by staged regeneration. However, the first stage of the regeneration process of Dean et al employs a dense bed which provides an opportunity for hydrothermal deactivation.

A major trend in fluid catalytic cracking processing has been modifications to the process to permit it to accommodate a wider variety of feedstocks, in particular, stocks that contain more nitrogen than had previously been permitted in a feed to a fluid catalytic cracking unit.

Along with the development of process modifications and catalysts which could accommodate heavier, dirtier feeds, there has been a growing concern about the amount of nitrogen contained in the feed that ended up as $NO_x$ in the regenerator flue gas. Some attempts have been made to minimize the amount of $NO_x$ discharged to the atmosphere through the flue gas by employing multiple beds in a fluid catalytic cracking regenerator.

U.S. Pat. No. 4,325,833 to Scott discloses a three-stage regenerator directed to $NO_x$ removal. Scott discloses that his middle stage contains a substantially oxygen-free atmosphere to convert $NO_x$ to $N_2$. However, flue gas from lower beds contact with catalyst from upper beds. This is detrimental because the flue gas contains water which can deactivate the catalyst by hydrothermal degradation.

It would be advantageous to provide a process which both minimizes $NO_x$ and hydrothermal degradation.

SUMMARY OF THE INVENTION

It is one object of the present invention to provide a staged fluid catalytic cracking regeneration process and apparatus which minimizes hydrothermal degradation.

It is another object of the present invention to provide a fluid cracking process and apparatus which simultaneously minimizes hydrothermal degradation and $NO_x$.

The present invention minimizes hydrothermal degradation of crystalline zeolite fluid catalytic cracking (FCC) catalyst and $NO_x$ in FCC regenerator flue gas by burning hydrocarbons from the coked catalyst in three stages and removing flue gas after each stage of burning. This minimizes hydrothermal degradation because the flue gas contains steam. This is particularly advantageous in fluid catalytic cracking processes which employ ZSM-5. The present invention preferably adds just enough air per regeneration stage to sustain combustion in at least part of each stage and, at the same time, remove the water formed during the combustion.

The present invention minimizes $NO_x$ by passing a mixture of catalyst and gases through the first and second stages in plug-type flow and by employing insufficient oxygen to sustain complete combution throughout the first and second stages. The process injects just enough air at the inlets to the first and second stages to sustain combustion at the inlet and partly through the stage. This burns off coke and forms $NO_x$. However, the mixture is oxygen-lean, and preferably has an oxygen content between 0 and 1 mole %, most preferably between 0 and 0.5 mole %, of the gas of the mixture by the time the mixture exits from the first and second stages. This reduces the amount of $NO_x$ emissions exiting these stages. The present invention minimizes $NO_x$ in the third stage by employing the minimum amount of oxygen in the third stage to sustain combustion.

The first stage regeneration occurs in a riser regenerator, by contacting catalyst with a first oxygen-containing gas stream, followed by quick separation of a first flue gas stream from the regenerator effluent. A second stage regeneration is provided by a fast fluid bed wherein catalyst, from the first stage, contacts a second oxygen-containing gas stream and a second flue gas stream is then separated from the catalyst. In the third stage, the catalyst, from the second stage, contacts a third oxygen-containing gas stream, and thus forms a third flue gas stream which is separated from the catalyst. The catalyst in the first riser is maintained at a temperature between 1000° and 1250° F. The catalyst in the fast fluid bed is maintained at a temperature between 50° F. above the temperature of the catalyst in the first riser and 1300° F. The second bed of catalyst is maintained at a temperature between 25° F. above the fast fluid bed temperature and 1600° F.

The present invention also provides staged regeneration by passing a spent catalyst-gas stream through a transport reactor in basically plug flow, and sequentially contacting the stream with a plurality of oxygen-containing streams.

DETAILED DESCRIPTION OF THE INVENTION

A fluid catalytic cracking (FCC) process employs a catalyst in the form of fine particles which act as a fluid when aerated with a vapor. The fluidized catalyst is circulated continuously between a reactor and a regenerator and acts as a vehicle to transfer heat from the regenerator to the hydrocarbon feed and reactor. The fluid catalytic cracking process converts heavy hydrocarbons into more valuable gasoline and lighter products.

Figure 1:
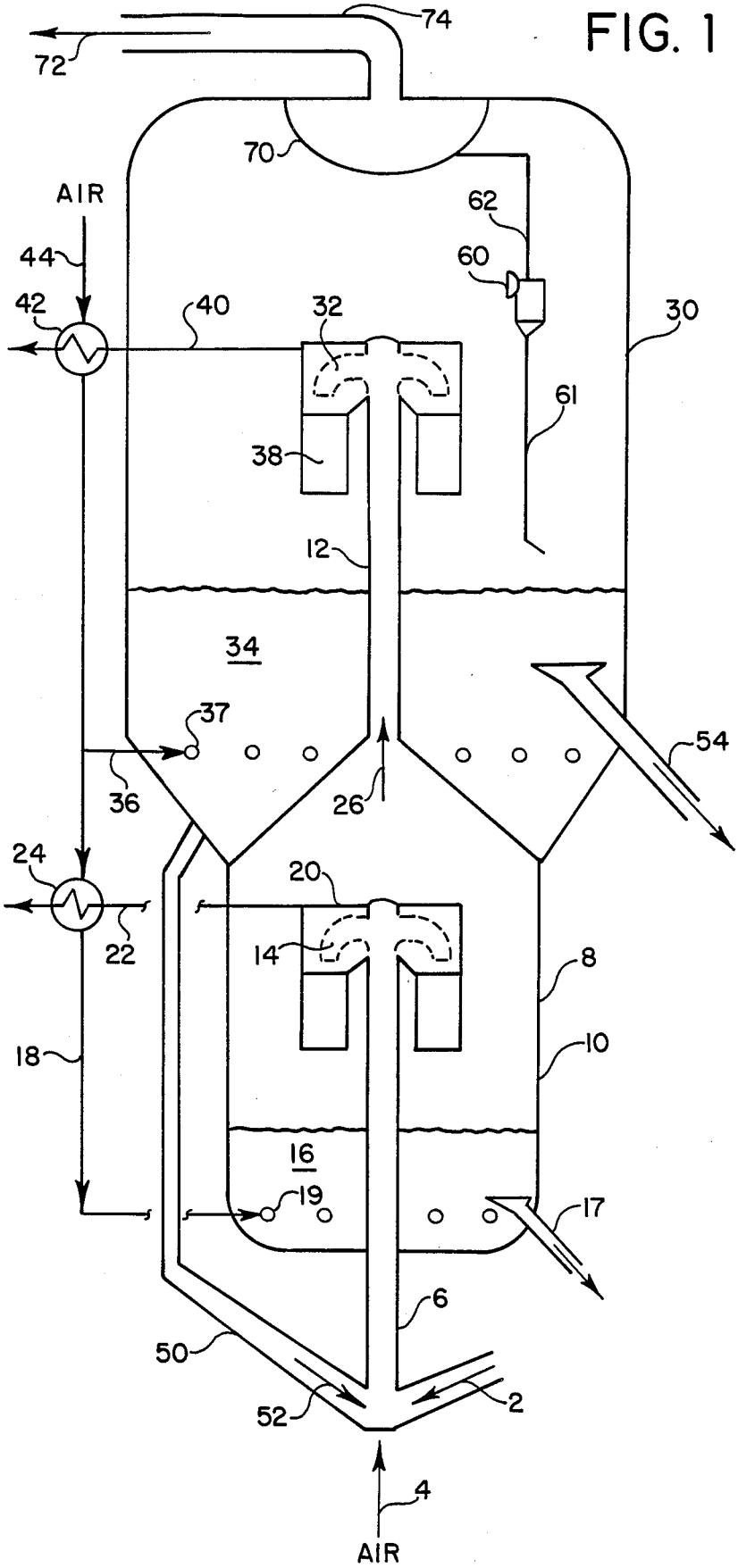
FIG. 1 is a schematic representation of a partial cross-section of a fluid catalytic cracking (FCC) regenerator of a first embodiment of the present invention.

FIG. 1 discloses a spent catalyst stream 2 from a fluid catalytic cracking reactor (not shown). The spent catalyst may be any fluid catalytic cracking catalyst, but preferably comprises particles comprising intermediate pore zeolite catalyst or particles comprising large pore zeolite catalyst, most preferably comprising ZSM-5 or zeolite Y, respectively. The spent catalyst stream 2 combines with a first airstream 4, and preferably a regenerated recycle catalyst 52 from an optional standpipe 50, to form a mixture. The mixture passes through a first regenerator riser 6. Preferably, the mixture passes through riser 6 in basically plug-type flow at regeneration conditions comprising a mixture temperature between 1000° and 1250° F. The process injects enough air through airstream 4 to sustain combustion at the inlet and partly through the riser 6. This burns off coke and forms $NO_x$. Because the mixture through the riser 6 is basically in plug flow and oxygen is consumed, by combution, the oxygen concentration varies along the riser 6. When the spent catalyst initially combines with airstream 4, the initial oxygen concentration is sufficiently high to promote combustion. Then as combustion continues, the oxygen concentration lessens sufficiently to shift equilibrium, denoted by the following reaction, to convert $NO_x$, produced during combustion, to $N_2$:

$$2NO_x \rightarrow N_2 + xO_2$$

The mixture is oxygen-lean, preferably having an oxygen concentration between 0 and 1 mole %, most preferably between 0 and 0.5 mole %, of the gas of the mixture by the time the mixture exits the riser 6. This converts a portion of the $NO_x$ to $N_2$ prior to exiting the riser 6. The mixture is discharged from the first riser 6 and passes into a plurality of discharge arms 14 which impart downward momentum to the mixture. The discharge arms 14 are housed within a riser cover 20.

After exiting the discharge arms 14, a portion of flue gas contacts upwardly passing gas from a first catalyst bed 16 to form a first flue gas stream 22. The remaining catalyst from the mixture continues downwardly into the first catalyst bed 16, which is located in a lower portion 10 of a second regenerator riser 8. Riser 8 is a fast fluid bed riser. A fluid catalytic cracking regenerator which employs a fast fluid bed riser is disclosed in U.S. Pat. No.4,444,722 to Owen, herein incorporated by reference. The lower portion 10 has a larger inside diameter than an upper portion 12 to which it is attached. A second airstream 18 passes through a header 19 into the first catalyst bed 16 to promote further regeneration. Stream 18 may be preheated by indirect heat exchange with the first flue gas stream 22 in a heat exchanger 24. The amount of air passed into the first catalyst bed 16 is preferably the minimum amount sufficient to sustain combustion in the bed 16, so that hydrogen is removed from catalyst without substantial hydrothermal degradation. Furthermore, the process injects just enough air through airstream 18 to sustain combustion in the bed 16 and partly through the second riser 8. This burns off the coke and forms $NO_x$. However, the mixture is sufficiently oxygen-lean to shift equilibrium to favor converting $NO_x$ to $N_2$, preferably having an oxygen concentration between 0 and 1 mole %, most preferably between 0 and 0.5 mole %, of the gas of the mixture by the time the mixture exits the riser 8. This converts a portion of the $NO_x$ to $N_2$ prior to exiting the second riser 8. The temperature of the catalyst in bed 16 is preferably maintained between 50° F. above that of the mixture discharged from riser 6 and 1300° F.

The airstream 18 and combustion products formed in bed 16 elutriate a first catalyst stream 26 away from first bed 16. The catalyst stream 26 passes upwardly away from bed 16 into the upper portion 12 of the second regeneration riser 8. A second catalyst stream can be withdrawn from bed 16 through an optional conduit 17 and sent to a fluid catalytic cracking reactor (not shown).

The catalyst stream 26 passes through upper portion 12, which is located within a catalyst collecting chamber 30. Stream 26 discharges from upper portion 12 into a plurality of discharge arms 32 which impart downward momentum to the stream 26. The discharge arms 32 are housed within a riser cover 38, and the downwardly directed catalyst countercurrently contacts combustion gases from a second catalyst bed 34 located therebelow. The combustion gases displace gaseous material upwardly and away from the downwardly directed catalyst. The displaced gases form a second flue gas stream 40 which exits the chamber 30 and indirectly preheats an airstream 44 in indirect heat exchanger 42. The catalyst continues downwardly to the second catalyst bed 34. A third airstream 36 passes through a header 37 into the second bed 34 to contact catalyst in bed 34. The amount of air passed into the second catalyst bed 34 through airstream 36 is, preferably, the minimum amount sufficient to sustain combustion in the bed 34 so that hydrogen is removed from catalyst, with minimal hydrothermal degradation and minimal $NO_x$ formation. The $NO_x$ formation is also minimized because a substantial portion of nitrogen originally in stream 2 has been removed by the first and second stages. The temperature of the catalyst in bed 34 is preferably maintained between 25° F. above that of bed 16 and 1600° F.

The regenerated recycle catalyst 52 is withdrawn from second catalyst bed 34 through a standpipe 50 and the catalyst 52 combines with airstream 4 and spent catalyst stream 2, as discussed above. A regenerated catalyst product is withdrawn from second catalyst bed 34 through a catalyst withdrawal conduit 54 and passed to a fluid catalytic cracking reactor (not shown). Combustion gases from second bed 34, which do not exit as part of second flue gas stream 40, pass upwardly through the collecting chamber 30 to a cyclone 60, which separates gaseous material from entrained catalyst particles and passes the gaseous materials through an overhead conduit 62 to a plenum chamber 70 and out of the plenum chamber 70 through a withdrawal conduit 74 as a third flue gas stream 72. A number of cyclones, such as cyclone 60, in series or parallel, or both, may be provided within chamber 30. Solids separated by cyclone 60 return to second catalyst bed 34 through a dipleg 61. A second portion of regenerated catalyst is withdrawn from bed 34 through the catalyst withdrawal conduit 54 and passes to a fluid catalytic cracking reactor (not shown).

This embodiment is particularly advantageous in catalyst systems employing particles comprising intermediate pore zeolite catalyst, such as ZSM-5, or particles comprising large pore zeolite catalysts, such as zeolite Y. It is desirable to subject the larger pore zeolite catalysts to more regeneration than the intermediate pore zeolite catalysts, because the larger pore zeolite catalysts tend to deactivate with coke more readily than the intermediate pore zeolite catalysts.

Figure 2:
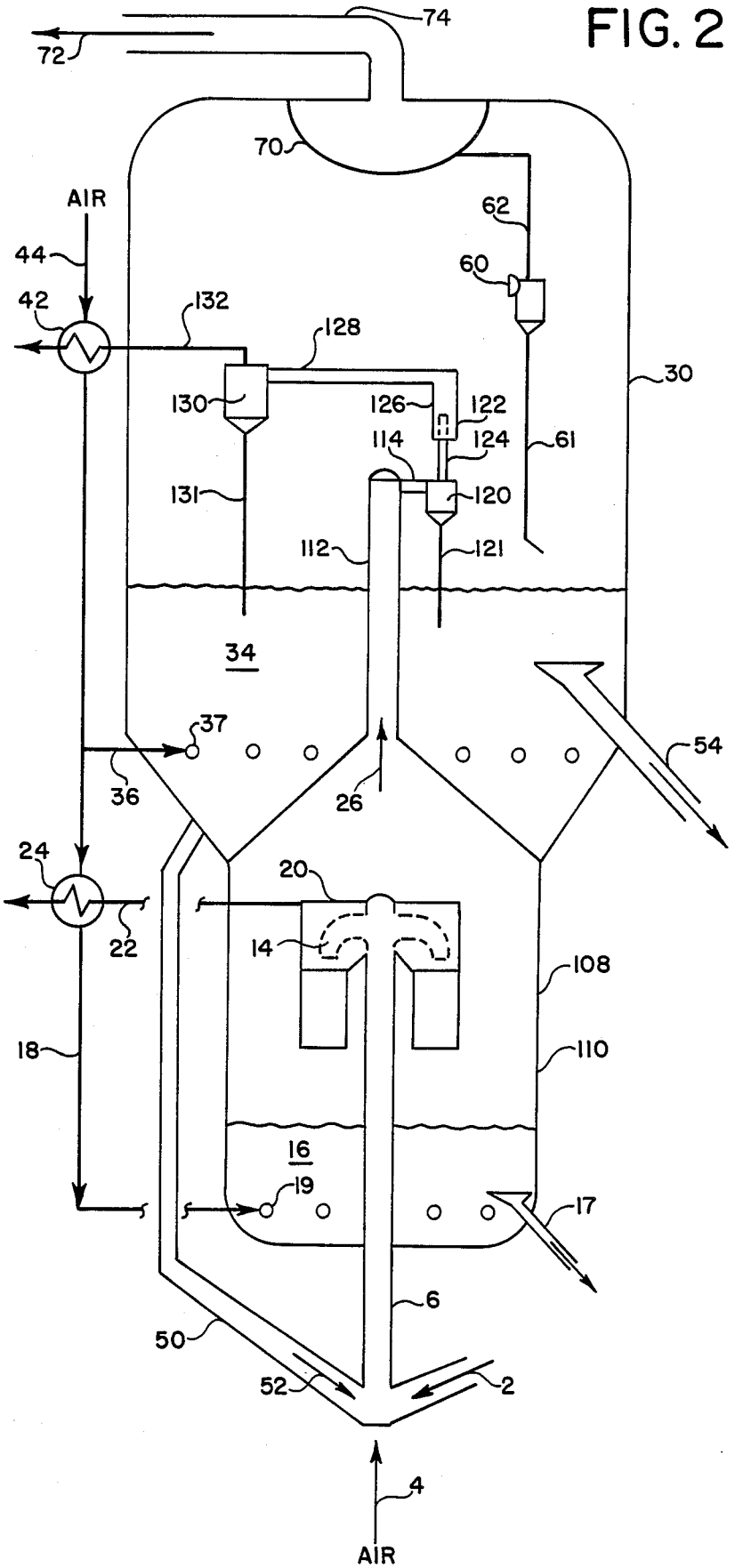
FIG. 2 is a schematic representation of a partial cross-section of a fluid catalytic cracking (FCC) regenerator of a second embodiment of the present invention.

In a second embodiment of the present invention, shown in FIG. 2, the combination of discharge arms 32 and riser cover 38 of FIG. 1 is replaced by a series of closed cyclones. Like-numbered features in FIGS. 1 and 2 operate in the same way. U.S. Pat. No. 4,404,095 to Haddad et al discloses discharge arms and a riser cover applied to a stripping section of a fluid catalytic cracking reactor vessel, and is incorporated herein by reference. U.S. Pat. No. 4,502,947 to Haddad et al shows a closed cyclone system applied to a fluid catalytic cracking reactor vessel, and is also incorporated herein by reference. As shown in FIG. 2, the catalyst stream 2, airstream 4 and first portion of regenerated catalyst 52 are combined and pass upwardly through the first regenerator riser 6 into a second regenerator riser 108 having a lower portion 110 attached to an upper portion 112. A flue gas stream 22 is separated from the catalyst discharged from the riser 6 and the remaining catalyst from the mixture passes to a first catalyst bed 16. A catalyst stream 26 passes upwardly from bed 16 through the upper portion 112 of the second riser 108. Optionally, a portion of catalyst may be withdrawn from bed 16 by an optional conduit 17 and recycled to a fluid catalytic cracking reactor (not shown).

The catalyst stream 26 discharges from the upper portion 112 into a riser cyclone inlet conduit 114 to a riser cyclone 120. The riser cyclone 120 is connected to a primary cyclone 130 by means of a riser cyclone overhead conduit 122. The primary cyclone 130 may be attached to a secondary cyclone (not shown) by a conventional enclosed conduit (not shown). Overhead gas from the primary cyclone 130, or secondary cyclones in series (not shown), forms a second flue gas stream which exits the collecting vessel 30 through an overhead conduit 132.

The riser cyclone overhead conduit 122 includes a lower vertical conduit 124, attached to the cyclone 120, which is inserted into an upper vertical conduit 126. Conduit 126 is in turn attached to a primary cyclone inlet conduit 128. An annulus is formed between conduit 124 and conduit 126 so that a portion of gas from catalyst bed 34 may pass into upper conduit 126. Preferably, the annulus is sized such that the velocity of the gas into the annulus is between 5 and 100 feet per second. Catalyst separated in cyclones 120 and 130 pass through diplegs 121, 131 to the second catalyst bed 34. The combustion gases from second bed 34, which do not exit as part of the second flue gas stream, pass into one or more cyclones 60 and exit through overhead conduit 62 to plenum chamber 70 and through the withdrawal conduit 74 as a third flue gas stream 72. Catalyst separated in cyclone 60 returns to the second catalyst bed 34 through a dipleg 61.

Similar to the first embodiment, the risers 6, 108 operate at oxygen-lean conditions. The first and second airstreams 4, 18 preferably supply enough air so that the mixtures exiting the first riser 6 and fast fluid bed riser 108 comprise gas having an oxygen concentration between 0 and 1 mole %, most preferably between 0 and 0.5 mole %. Exiting the first riser 6 is defined as when the mixture passes into discharge arms 14. Exiting the fast fluid bed riser is defined as when the mixture passes out of riser upper portion 112 into conduit 114. Airstream 36 preferably provides the minimum amount of air necessary to sustain combustion in bed 34.

The above oxygen-lean conditions have the advantage that they promote conversion of $NO_x$, produced during coke combustion, to $N_2$ prior to passing flue gas out of each regeneration stage.

Figure 3:
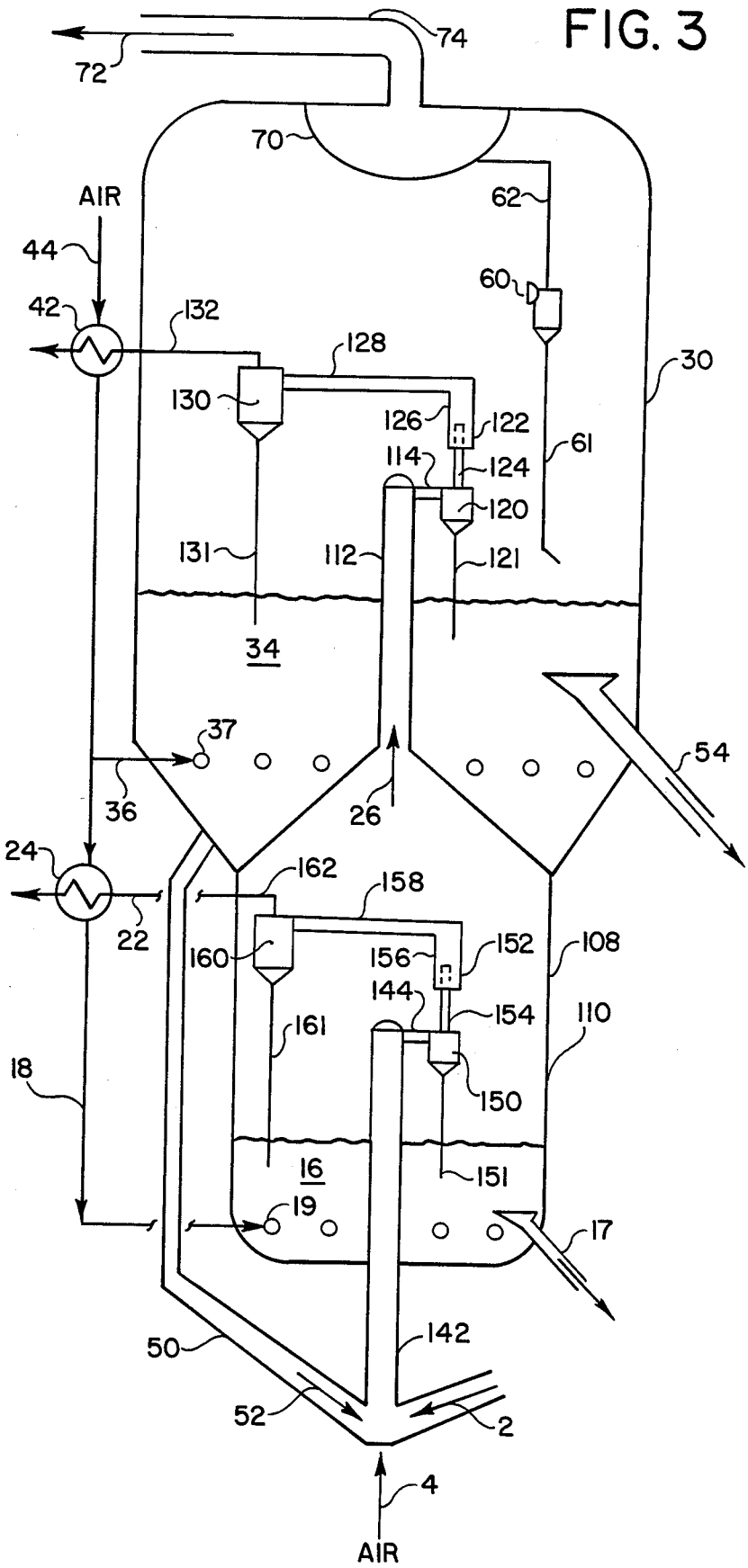
FIG. 3 is a schematic representation of a partial cross-section of a fluid catalytic cracking (FCC) regenerator of a third embodiment of the present invention.

In a third embodiment of the present invention, shown in FIG. 3, the combination of discharge arms 14 and riser cover 20 of FIG. 2 is replaced by a series of closed cyclones. In FIGS. 2 and 3, like-numbered features operate in the same way. U.S. Pat. No. 4,404,095 to Haddad et al discloses discharge arms and a riser cover applied to a stripping section of a fluid catalytic cracking reactor vessel, and is incorporated herein by reference. U.S. Pat. No. 4,502,947 to Haddad et al shows a closed cyclone system applied to a fluid catalytic cracking reactor vessel, and is also incorporated herein by reference. As shown in FIG. 3, the catalyst stream 2, airstream 4 and first portion of regenerated catalyst 52 are combined and pass upwardly through a first regenerator riser 142 into a second regenerator riser 108 having a lower portion 110 attached to an upper portion 112. A closed cyclone system separates a flue gas stream 22 from the catalyst discharged from the riser 142, as discussed below. The remaining catalyst from the mixture passes to a first catalyst bed 16. A catalyst stream 26 passes upwardly from bed 16 through the upper portion 112 of the second riser 108. Optionally, a portion of catalyst may be withdrawn from bed 16 by an optional conduit 17 and recycled to a fluid catalytic cracking reactor (not shown).

The closed cyclone system separates the flue gas stream 22 from the catalyst discharged from the riser 142 as follows. The catalyst stream discharges from the riser 142 into a riser cyclone inlet conduit 144 to a riser cyclone 150. The riser cyclone 150 is connected to a primary cyclone 160 by means of a riser cyclone overhead conduit 152. The primary cyclone 160 may be attached to a secondary cyclone (not shown) by a conventional enclosed conduit (not shown). Overhead gas from the primary cyclone 160, or secondary cyclones in series (not shown), forms the first flue gas stream 22 which exits the second riser 108 through an overhead conduit 162.

The riser cyclone overhead conduit 152 includes a lower vertical conduit 154, attached to the cyclone 150, which is inserted into an upper vertical conduit 156. Conduit 156 is in turn attached to a primary cyclone inlet conduit 158. An annulus is formed between conduit 154 and conduit 156 so that a portion of gas from catalyst bed 16 may pass into upper conduit 156. Preferably, the annulus is sized such that the velocity of the gas into the annulus is between 5 and 100 feet per second. Catalyst separated in cyclones 150 and 160 pass through diplegs 151, 161 to the first catalyst bed 16.

Similar to the second embodiment, the risers 142, 108 operate at oxygen-lean conditions. The first and second airstreams 4, 18 preferably supply enough air so that the mixtures exiting the first riser 142 and fast fluid bed riser 108 comprise gas having an oxygen concentration between 0 and 1 mole %, most preferably between 0 and 0.5 mole %. Exiting the first riser 142 is defined as when the mixture passes into cyclone inlet conduit 144. Exiting the fast fluid bed riser is defined as when the mixture passes out of riser upper portion 112 into conduit 114. Airstream 36 preferably provides the minimum amount of air necessary to sustain combustion in bed 34.

The above oxygen-lean conditions have the advantage that they promote conversion of $NO_x$, produced during coke combustion, to $N_2$ prior to passing flue gas out of each regeneration stage.

Figure 4:
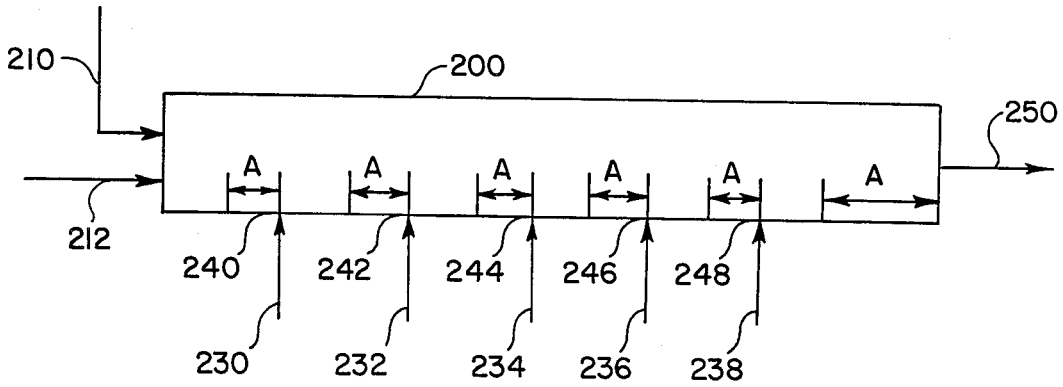
FIG. 4 is a schematic representation of a fluid catalytic cracking (FCC) regenerator of a fourth embodiment of the present invention.

FIG. 4 discloses a fourth embodiment of the present invention. The fourth embodiment is a transport-type regenerator reactor comprising a transport conduit 200 provided with a plurality of oxygen-containing airstreams 230, 232, 234, 236 and 238 sequentially provided along a portion of the conduit 200 at respective injection points 240, 242, 244, 246, 248. Each injection point 240, 242, 244, 246, 248 represents one or more injection nozzles about the perimeter of the conduit 200. The conduit 200 may be horizontal or vertical.

A spent catalyst stream 210, from a fluid catalytic cracking reactor (not shown), and an oxygen-containing airstream 212 pass into the conduit 200 and form a mixture. Preferably, the catalyst contains a large pore zeolite catalyst or intermediate pore zeolite catalyst. Most preferably, the large pore zeolite catalyst contains zeolite Y and the intermediate pore zeolite catalyst contains ZSM-5. The mixture passes through the conduit 200 and sequentially contacts the plurality of oxygen-containing airstreams 230, 232, 234, 236, 238 at regenerating conditions.

The regenerating conditions in the conduit 200 include a gas residence time between 1 and 60 seconds, preferably between 1 and 25 seconds, and a mixture temperature between 1000° and 1600° F. The gas residence time between contacting the mixture with each airstream 230, 232, 234, 236, 238 is preferably at least 0.5 seconds. Said mixture passes through said transport conduit 200 in basically plug flow. Each portion of conduit 200 between the sequential injection points 240, 242, 244, 246, 248 acts as another regeneration stage.

The oxgen concentration varies along conduit 200. When the catalyst initially contacts the airstreams 212, 230, 232, 234, 236, 238, the initial oxygen concentration is sufficiently high to promote combustion. Then, as combustion continues, the oxygen is depleted so that the mixture passes through a region A of relatively lower oxygen concentration. The oxygen concentration in the region A is sufficiently low to shift equilibrium, denoted by the following reaction to convert $NO_x$, produced during regeneration, to $N_2$:

$$NO_x \rightarrow N_2 + xO$$

A regenerated mixture 250 then exits the conduit 200 and passes to cyclone, or other gas-solid separation device (not shown), to separate into a flue gas stream and a regenerated catalyst stream. The regenerated catalyst may then undergo further regeneration or pass to a fluid catalytic cracking reactor (not shown) for combination with fluid catalytic cracking hydrocarbon feed. Further regeneration may occur by recycling, the separated catalyst to conduit 200, or in subsequent regenerator stages. For example, the conduit 200 may substitute for riser 6 of FIGS. 1 and 2, or riser 142 of FIG. 3.

The first, second and third embodiments of the present invention have the advantage that regenerating fluid catalytic cracking catalyst in stages, and quickly removing flue gas from the catalyst in each stage, minimizes hydrothermal degradation and minimizes $NO_x$ formation.

The fourth embodiment of the present invention provides multistage regeneration, to reduce $NO_x$, in a single transport conduit. This is particularly useful in retrofitting FCC regenerators.

It is preferred, for reducing $NO_x$ in flue gas from fluid catalytic cracking regeneration wherein the regeneration is conducted in a transport conduit, in plug flow, at catalyst regeneration conditions, that the conduit be sized for a catalyst residence time between 1 and 240 seconds, and most preferably between 1 and 60 seconds. Preferably, the transport conduit is sized to provide a catalyst residence time of at least 1.5 seconds in between sequential points of injection of oxygen-containing streams.

We claim:

1. An apparatus for reducing $NO_x$ in flue gas from fluid catalytic cracking regeneration of a spent catalyst, comprising:

a first regenerator riser having an inlet at a lower portion for a first mixture of said spent catalyst and a first oxygen containing gas wherein said first riser has a lower portion where $NO_x$ is formed during regeneration, and having an upper portion, where a portion of said $NO_x$ is converted to $N_2$ means connective with said upper portion of said riser for discharging and separating a first flue gas stream and a catalyst stream from said discharged first mixture, and wherein said separation means passes said catalyst stream to a first dense catalyst bed and means for withdrawing said first flue gas stream from said apparatus, a second regenerator riser having a lower portion containing said first dense bed and an upper portion above said first dense bed means for adding a second oxygen-containing stream to said first bed to form a second mixture of catalyst and gases comprising $NO_x$ and wherein said second mixture is discharged up through said upper portion of said second riser and a portion of said $NO_x$ in said second mixture is converted to $N_2$;

and means for discharging and separating an at least partially regenerated catalyst stream and a second flue gas stream from said second riser.

2. The apparatus of claim 1 further comprising:

a catalyst collecting chamber connective with said second riser catalyst discharge means;

means for adding a third oxygen-containing stream to said catalyst collecting chamber;

a conduit for withdrawing a first portion of regenerated catalyst catalyst from said catalyst collecting chamber and means for withdrawing a third flue gas stream from an atmosphere of said collecting chamber.

3. The apparatus of claim 1 wherein said means for discharging and separating from said first riser comprises a plurality of downwardly directed arms extending radially from an upper discharge end of said first riser, and said means for separating said discharged first mixture comprises a first riser cover which surrounds said first plurality of arms.

4. The apparatus of claim 1 wherein said means for discharging and separating from said second riser comprises a plurality of downwardly directed arms extending radially from an upper discharge end of said second riser, and a second riser cover which surrounds said second plurality of arms.

5. The apparatus of claim 1 wherein said means for discharging and separating from said second riser comprises a closed cyclone system attached to said second riser.

6. The apparatus of claim 1 wherein said means for discharging and separating from said first riser comprises a closed cyclone system attached to said first riser.

7. The apparatus of claim 2 further comprising means for heating said second and third oxygen-containing streams by indirect heat exchange with said first and second flue gas streams, respectively.

8. The apparatus of claim 2 wherein said means for withdrawing said third flue gas stream comprises cyclones in communication with an atmosphere of said collecting chamber.

9. An apparatus for reducing $NO_x$ in flue gas from a regenerator for regenerating a spent fluid catalytic cracking catalyst stream comprising a mixture of ZSM-5 catalyst and zeolite Y catalyst particles from a fluid catalytic cracking reactor to produce regenerated catalyst, comprising:

a first regenerator riser having an inlet in a lower portion thereof for regenerating a first mixture of said spent catalyst stream, a portion of regenerated catalyst and a first oxygen-containing stream by passing said first mixture therethrough and an outlet in an upper portion of said first riser for discharging a mixture of catalyst and first flue gas from said first riser;

a second regenerator riser comprising a lower portion adapted to contain a dense bed of catalyst and an upper portion above said lower portion, said lower portion having a larger inside diameter than said upper portion;

means for separating and discharging said first mixture from said first riser and downwardly directing catalyst from said first mixture from said first riser to a first catalyst bed located in said lower portion having a larger inside diameter;

means for withdrawing from said apparatus said first flue gas stream from said discharged first mixture;

means for adding a second oxygen-containing stream to said first bed;

means for passing a second mixture of catalyst and gases comprising said $NO_x$ from said first bed into said upper portion of said second riser wherein at least a portion of said $NO_x$ is converted to $N_2$ in said second riser upper portion;

an enlarged catalyst collecting chamber above said first catalyst bed comprising an upper portion and a lower portion;

means for discharging said second mixture from said second riser and downwardly directing said second mixture from said second riser to a second catalyst bed located in said lower portion of said collecting chamber;

means for separating a second flue gas stream from said second mixture prior to passing said second mixture into said second bed;

means for adding a third oxygen-containing gas stream to said second bed;

means for recycling regenerated catalyst from said second bed to said first riser;

means for withdrawing regenerated catalyst from said second bed; and means for separating a third flue gas stream from an atmosphere of said collecting chamber above said second bed.

* * * * *